US005980127A

United States Patent [19]

Ogiwara

[11] Patent Number: 5,980,127

[45] Date of Patent: Nov. 9, 1999

[54] IMAGE FORMING APPARATUS

[75] Inventor: Nagao Ogiwara, Kanagawa, Japan

[73] Assignee: Fuji Photo Film Co., Ltd., Kanagawa, Japan

[21] Appl. No.: 09/055,305

[22] Filed: Apr. 6, 1998

[30] Foreign Application Priority Data

Apr. 7, 1997 [JP] Japan ..... 9-088397

[51] Int. Cl.[6] ..... G03D 13/00

[52] U.S. Cl. ..... 396/575

[58] Field of Search ..... 396/575; 355/27–29, 355/400, 100; 250/318, 319, 316.1, 317.1; 219/216

[56] References Cited

FOREIGN PATENT DOCUMENTS

| | | | |
|---|---|---|---|
| 9-114066 | 5/1997 | Japan | 396/FOR 919 |
| 10-260518 | 9/1998 | Japan | 396/FOR 918 |
| 9-304906 | 11/1998 | Japan | 396/FOR 919 |

*Primary Examiner*—D. Rutledge

*Attorney, Agent, or Firm*—Sughrue, Mion, Zinn, Macpeak & Seas, PLLC

[57] ABSTRACT

An image forming apparatus in which dry developing processing section which carries out a developing processing which makes visible a latent image which has been recorded on a photosensitive material by laminating to each other the photosensitive material on which the latent image has been recorded and a processing material containing a processing agent and carrying out a heat-processing thereon; a data generating section which picks up the image which has been developed and generates digital image data; an exposing section which exposes a heat developing photosensitive material on the basis of the digital image data so that a latent image corresponding to the digital image data is recorded; and a heat developing transfer section which carries out a developing processing which makes visible a latent image which has been recorded on a heat developing photosensitive material by laminating to each other the heat developing photosensitive material which has been exposed and the image receiving material and carrying out a heat-processing thereon, and a transfer processing which transfers the image which has been developed onto the image receiving material, are housed in one casing.

16 Claims, 8 Drawing Sheets

IMAGE FORMING APPARATUS

BACKGROUND OF THE INVENTION

1. Field of the Invention

The present invention relates to an image forming apparatus, and more particularly, to an image forming apparatus which effects a dry processing by using a photosensitive material which has been photographed and to which a dry processing is applicable so as to make hard copies.

Conventionally, in a film developing machine, a photographic film which has been photographed is sequentially dipped into processing solutions comprising a developing solution, a fixing solution, a washing solution and the like which are reserved in respective processing solution tanks so that a latent image which is recorded on a photographic film is made distinct (wet developing). Thereafter, a print processing is effected on a printing paper in a printer which is equipped independently of the film developing machine. Further, after the print processing, a paper developing machine is used so that the printing paper is dipped into processing solutions in respective processing solution tanks, and a developing processing is effected (wet developing). Moreover, a machine in which a printer and a paper developing machine are formed integrally with each other is named a so-called "minilab" (a small business that develops film and makes prints quickly) which is used for shops on a small scale.

In the image forming apparatus which is structured as described above, because the film developing machine and the printer are equipped separately from each other, manual work must be done by an operator in order to pick up photographic film, which has been subjected to a developing processing, from a film developing machine and load the photographic on a printer. Therefore, in order to reduce the amount of the manual work by the operator, a method in which the film developing machine and the printer are formed integrally with each other has been thought of. In this case, because a photographic film and a printing paper must be conveyed in a state in which they intersect orthogonally to each other, there arises a problem that the image forming apparatus must be made large, so that the above-described integration of the film developing machine and the printer has not yet been realized. If the integration has been realized, it does not pay.

SUMMARY OF THE INVENTION

Instead of the aforementioned wet developing system, a dry developing system is recommended by the applicant of the present invention (Japanese Patent Application No. 9-4899). In this dry developing system, processings are effected by using two types of materials comprising a heat developing film (a photosensitive material) and a processing material which contains therein an agent which promotes to develop an image which has been stored in the heat developing film. In other words, in the dry developing system, the photosensitive material on which an image has been recorded and the processing material are laminated to each other, and the photosensitive material and the processing material which have been laminated to each other are subjected to a heat-developing for a predetermined period of time. Thereafter, the photosensitive material and the processing material are peeled from each other so as to form an image on the photosensitive material. Further, it is possible to digitally pick up an image from the photosensitive material which has been developed, to store information about the image in a storage medium as digital image data, and by using the digital image data, to reproduce the image as hard copies on another recording material. Among apparatuses which make hard copies, i.e., digital image recording apparatuses, as an apparatus which can provide an extremely high quality image, an image forming apparatus, in which a heat developing photosensitive material is exposed on the basis of digital image data, and is laminated to an image receiving material via an image forming solvent, and is thereby subjected to a heat developing transfer processing so that an image is formed on the image receiving material, has been developed.

However, the present situation is such that the above-described dry developing system and digital image recording apparatus using the heat developing photosensitive material have been developed separately from each other so that an apparatus in which the dry developing system and the digital image recording apparatus are formed integrally with each other has not yet been recommended. In the same manner as the wet developing, this is because it has been considered that the integration of the dry developing system and the digital image recording apparatus does not pay.

In view of the aforementioned facts, it is an object of the present invention to provide an image forming apparatus in which all of the processings from development to print (making hard copies) of a negative film which has been photographed are effected by a dry developing system, and which can realize processings which are needed for print with film processing (simultaneous printing) which is an existing so-called "color print" by making a relatively small apparatus.

In order to accomplish the aforementioned objects, the first aspect of the present invention is an image forming apparatus which comprises: dry developing processing means which carries out a developing processing which makes visible a latent image which has been recorded on a photosensitive material by laminating to each other the photosensitive material on which the latent image has been recorded and a processing material containing a processing agent and carrying out a heat-processing thereon; data generating means which picks up the image which has been developed and generates digital image data; exposing means which exposes a heat developing photosensitive material on the basis of the digital image data so that a latent image corresponding to the digital image data is recorded; and heat developing transfer means which carries out a developing processing which makes visible the latent image which has been recorded on a heat developing photosensitive material by laminating to each other the heat developing photosensitive material which has been exposed and an image receiving material and carrying out a heat-processing thereon, and a transfer processing which transfers the image which has been developed onto the image receiving material.

In accordance with the first aspect of the present invention, a dry developing processing section in which an image corresponding to the latent image which has been recorded on the photosensitive material is provided at the image forming apparatus. In this dry developing, the latent image which has been recorded on the photosensitive material is laminated to the predetermined processing material and heat-processed, and these materials which have been laminated to each other are peeled from each other so that the image corresponding to the latent image can be formed. The predetermined material which is used at this time contains therein an agent which can form an image by heating. For example, a CCD area sensor or the like is provided at the image picking up processing section. In this image picking up processing section, the image which is formed on the photosensitive material by the aforementioned dry developing processing section is pick up digitally so that the digital image data is created. The digital image data is transmitted to the exposing processing section which is provided at the image forming apparatus. Further, the heat developing transfer processing section is provided at the image forming apparatus. In this heat developing transfer processing section, it is preferable that the heat developing photosensitive material onto which an image has been exposed is laminated to the image receiving material under the existence of the image forming solvent and then a heat processing is effected thereon so that the image on the heat developing photosensitive material is transferred to the image receiving material. As a result, the same image as the latent image which has been recorded on the photosensitive material is printed on the image receiving material. The second aspect of the present invention is the image forming apparatus which comprises: detecting means which detects either the exposed portion or the unexposed portion of a photosensitive material; separating means which separates the photosensitive material into a first portion which includes the exposed portion of the photosensitive material and a second portion which does not include the exposed portion; dry developing processing means which carries out a developing processing which makes visible a latent image which has been recorded on the photosensitive material through exposure by laminating to each other the first portion of the photosensitive material which has been separated by the separating means and a processing material containing a processing agent, and carrying out a heat-processing thereon; data generating means which picks up the image which has been developed and generates digital image data; exposing means which exposes a heat developing photosensitive material on the basis of the digital image data so that a latent image corresponding to the digital image data is recorded; and heat developing transfer means which carries out a developing processing which makes visible the latent image which has been recorded on a heat developing photosensitive material, by laminating to each other the heat developing photosensitive material which has been exposed and an image receiving material, and carrying out a heat-processing thereon, and a transfer processing which transfers the image which has been developed onto the image receiving material.

In accordance with the second aspect of the present invention, the photosensitive material is separated into the first portion which includes the exposed portion and the second portion which does not include the exposed portion. Accordingly, the developing processing is effected merely on the exposed portion of the photosensitive material and the digital image data is generated from the developed image, the heat developed photosensitive material is exposed on the basis of the digital image data, and the exposed image is developed and thereby transferred onto the image receiving material.

In accordance with the second aspect, the second portion which does not include the exposed portion is taken up into a cartridge by take-up means so that the unexposed portion can be reused.

A third aspect of the present invention is an image forming apparatus which comprises: detecting means which detects whether a photosensitive material has been developed or not; dry developing processing means which carries out a developing processing which makes visible a latent image which has been recorded on a photosensitive material by laminating to each other the photosensitive material which has not been developed and on which the latent image has been recorded, and a processing material containing a processing agent, and carrying out a heat-processing thereon; data generating means which generates digital image data by picking up the image which has been recorded on a photosensitive material which is detected by the detecting means to have been developed, and by picking up the image which has been recorded on the photosensitive material which has been developed by the developing processing means; exposing means which exposes a heat developing photosensitive material on the basis of the digital image data so that a latent image corresponding to the digital image data is recorded; and heat developing transfer means which carries out a developing processing which makes visible a latent image which has been recorded on a heat developing photosensitive material by laminating to each other the heat developing photosensitive material which has been exposed and an image receiving material, and carrying out a heat-processing thereon, and a transfer processing which transfers the image which has been developed onto the image receiving material.

In accordance with the third aspect of the present invention, because the photosensitive material which has not been developed is developed by the dry developing processing means and conveyed to the data generating means, the photosensitive material which has been developed can be conveyed to the data generating means without passing through the dry developing processing means.

The image forming apparatus according to the above-described first, second and third aspects of the present invention further comprises: first conveying means which conveys the photosensitive material through the dry developing processing means and the data generating means and then discharges to the exterior portion of the image forming apparatus; and second conveying means which conveys the photosensitive material through the exposing means and the heat developing transfer means and discharges to the exterior portion of the image forming apparatus.

In the above-described first, second and third aspects of the present invention, at least two of the processings at the dry developing processing section, the image picking up processing section, the exposing processing section, and the heat developing transfer processing section can be effected simultaneously.

The image forming apparatus is provided with the dry developing processing section, the image picking up processing section, the exposing processing section and the heat developing transfer processing section. Times needed for the respective processings do not differ a great deal from each other. Therefore, in the image forming apparatus according to the present invention, since at least two of all the processings can be implemented concurrently, a number of cartridges which take up the photosensitive material thereinto can be processed at the same time so that prompt printing with film processing can be carried out. Further, if an operator makes sure which cartridge is loaded on the image forming apparatus, the present state or the like of the image forming apparatus can be judged.

Further, the respective processings at the dry developing processing section, the image picking up processing section, the exposing processing section, and the heat developing transfer processing section can be implemented at the same time on the basis of the image which has been recorded on the same photosensitive material.

As a result, respective processings at the dry developing processing section, the image picking up processing section, the exposing processing section, and the heat developing transfer processing section are effected on the same photosensitive material at the same time. This is useful when a customer places urgent orders for print with film processing, i.e., when a customer requires print with film processing in a short time.

DESCRIPTION OF THE PREFERRED EMBODIMENTS

Figure 1:
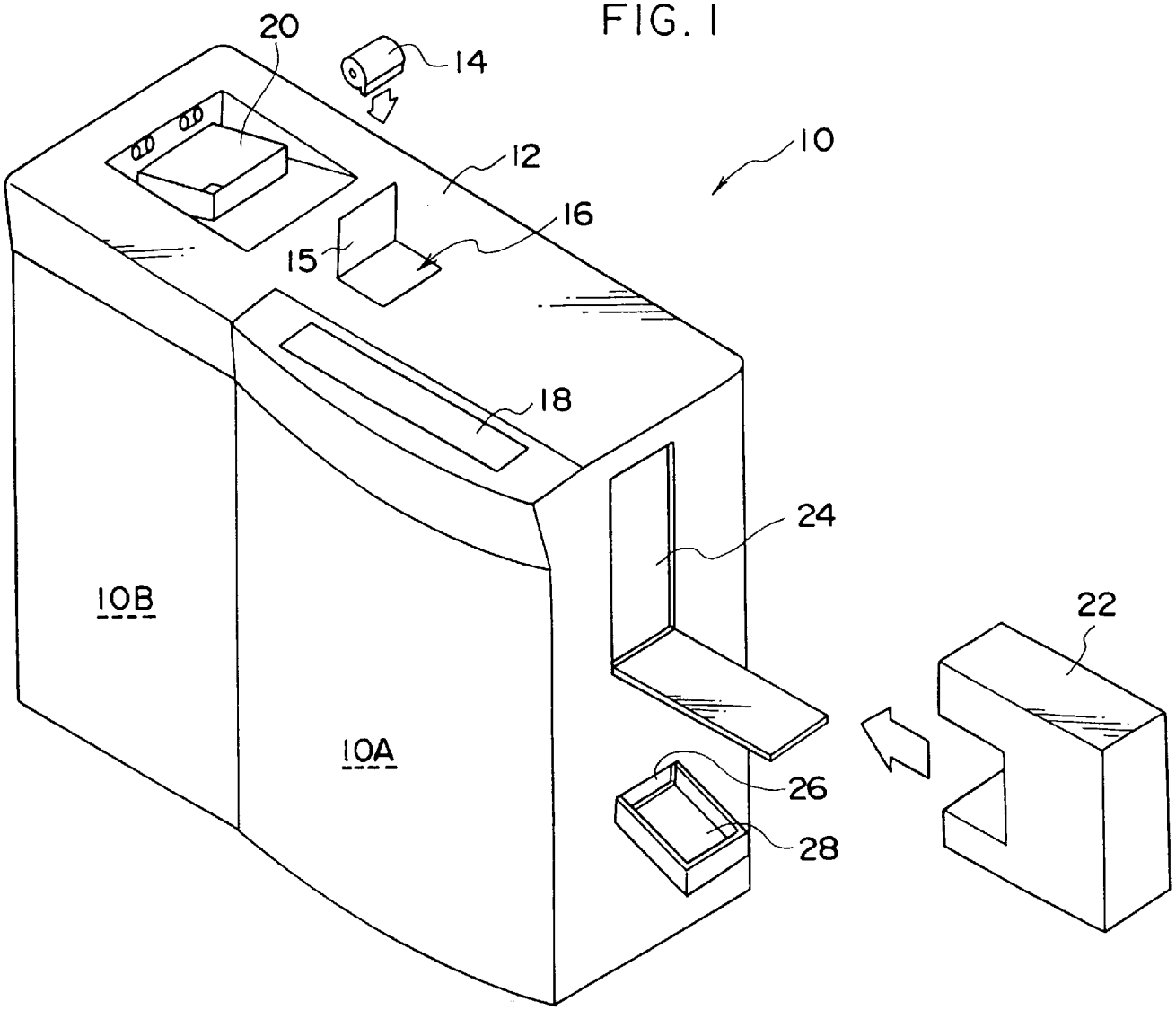
FIG. 1 is a perspective view illustrating the outward appearance of an image forming apparatus according to an embodiment of the present invention.

As shown in FIG. 1, an image forming apparatus 10 according to an embodiment of the present invention has a casing 12. A developing processing section 10A and a print processing section 10B are provided in the casing 12 in order to develop and print a negative film F which is accommodated in a cartridge 14.

Figure 2:
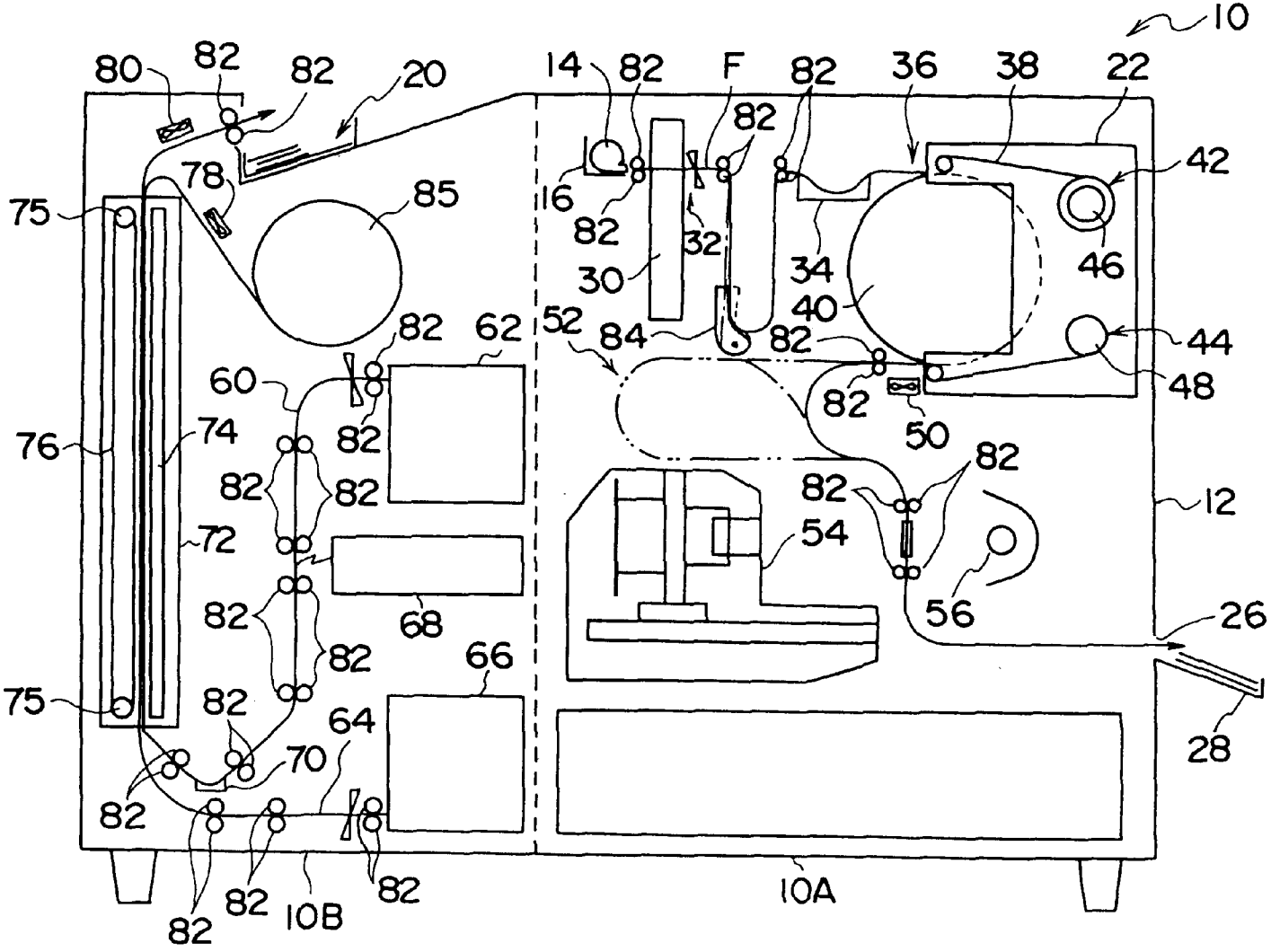
FIG. 2 is a structural view illustrating the internal structure of the image forming apparatus according to the present embodiment.

The internal structure of the image forming apparatus 10 is shown in FIG. 2.

A cartridge loading portion 16 is provided at the developing processing section 10A of the image forming apparatus 10. The cartridge loading portion 16 is formed in a rectangular shape as shown in FIG. 1. Further, an open/close window 15*a* which is shown in FIG. 1 is mounted to an upper portion of the cartridge loading portion 16 so as to open/close, and during the loading of the cartridge 14, the open/close window 15 is closed to block light.

A negative film information detecting section 30 is disposed downstream of the cartridge loading portion 16 in the conveying direction of the negative film F. The negative film information detecting section 30 detects the state of the negative film F; whether the detected portion of the negative film F which is pulled out from the cartridge 14 by a pair of conveying rollers 82 has been exposed or not; whether or not it has been developed, or the like. The state of the negative film F can be judged by detecting the differences in transmission densities of the negative film F by irradiating an infrared light onto the negative film F. Further, information as to whether the negative film F has been exposed or not, or information as to whether the negative film F has been developed or not is previously recorded on the negative film F having a magnetic recording layer thereon. Accordingly, the recorded information about the negative film F is pick up by a magnetic head so that the state of the negative film F may be judged.

A cutter 32 is disposed downstream of the negative film information detecting section 30 in the conveying direction of the negative film F. The utter 32 is operated on the basis of the information detected by the film information detecting section 30. For example, in a case in which the overall portion of the negative film F which is pulled out from the cartridge 14 has not been developed, when the cutter 32 is operated, the negative film F is thereby cut away from a spool (not shown) in the cartridge 14.

An application tank 34, which is filled with water as an image forming solvent, is disposed downstream of the cutter 32 in the conveying direction of the negative film F. In the vicinity of the application tank 34, disposed are a replenishing tank and a pump (not shown) for replenishing water into the application tank 34. The application tank 34 is formed in a disc shape and has a guide (not shown) which is formed in a circular arc shape and guides the negative film F thereinto. The negative film F is dipped into water in the application tank 34, and the water in the application tank 34 is applied to the negative film F. In the present embodiment, the application temperature in the application tank 34, i.e., the temperature of the water in the application tank 34 is set to 40° C., and the application time is set to 2.5 seconds. In addition, other than water, a mixture of water and a solvent having a low boiling point such as methanol, DMF, acetone, di-isobutylketone or the like is applicable to an image forming solvent. Further, a solution, which comprises a mixture of water or the aforementioned mixed solvent with one of an image forming promotor, an anti-fogging agent, a developing stop solution, a hydrophilic heating solvent, an antiseptic, an antimold and the like, or a mixture of the water or the aforementioned mixed solvent with the combination of a plurality thereof, may be applicable to the image forming solvent.

A heat developing section 36 is disposed downstream of the application tank 34 in the conveying direction of the negative film F. The heat developing section 36 is provided with a heat drum 40 and a processing sheet cassette 22. The heat drum 40 accommodates therein a heater (not shown) and is supported so as to be rotatable. The processing sheet cassette 22 accommodates therein a processing sheet 38 (see FIG. 2) which contains an agent which can help make distinct or visible a latent image which is laminated to the negative film F, is subjected to heating and pressing processings, and is thereby recorded on the negative film F. The processing sheet cassette 22 which is formed in a substantially U shape is provided with a processing sheet unwinding portion 42 as an accommodation portion of the processing sheet 38 and a processing taking up portion 44 as a retrieving portion of the processing sheet 38. A supplying shaft 46 which is rotated by a motor (not shown) is provided at the processing sheet unwinding portion 42. The elongated processing sheet 38 is wound around the supplying shaft 46. A take-up shaft 48 which is rotated by a motor (not shown) is mounted to the processing sheet take-up portion 44, and thereby takes up around the take-up shaft 48 the processing sheet 38 which is fed from the supplying shaft 46. As shown in FIG. 1, the processing sheet cassette 22 is disposed adjacent to the heat drum 40 by the processing sheet cassette 22 being loaded to the processing sheet cassette loading portion 24 which is provided at the side of the image forming apparatus 10.

In the heat developing section 36, the negative film F and the processing sheet 38 are laminated to each other by laminating means (not shown). The negative film F and the processing sheet 38 which have been laminated to each other are conveyed along the surface of the heat drum 40 by a pair of conveying rollers 82 which are provided at the discharge exit side of the heat developing section 36. At this point, as the temperature of the heat drum 40 is raised, the negative film F and the processing sheet 38 which have been laminated to each other are subjected to heating and pressing processings for a predetermined period of time so that the latent image of the negative film F can be made distinct. In the present embodiment, the developing temperature at the heat developing section 36 is set to 80° C., and the developing time is set to 15 seconds.

An unillustrated peeling means and a fan 50 serving as a dry section are provided downstream of the heat developing section 36 in the conveying direction of the negative film F. The peeling means peels the processing sheet 38 off the negative film F to which it have been laminated. The negative film F which has been peeled from the processing sheet 38 is dried by the fan 50 and is conveyed by the pair of conveying rollers 82 in a predetermined direction thereof. On the other hand, the processing sheet 38 is taken up around the take-up shaft 48 in the processing sheet cassette 22

An insertion buffer portion 52 is provided downstream of the fan 50 in the conveying direction of the fan 50. An unillustrated branch guide (not shown) is provided at the insertion buffer portion 52. By switching over the position of the branch guide, the conveying path of the negative film F can be changed. Accordingly, it is possible to absorb the speed difference between the processing speeds of the heat developing section 36 and an image information picking up section which will be described hereinafter.

A light source 56 and the image information picking up section 54 are provided at a position at which the negative film F is interposed therebetween, downstream of the insertion buffer portion 52 in the conveying direction of the negative film F. The light source 56 is used when an image is pick up at the image information picking up section 54. A CCD (Charge Coupled Device) area sensor is provided at the image information picking up section 54. In this image information picking up section 54, the image which is made distinct by the heat developing section 36 and formed on the negative film F is pick up by the CCD area sensor and is A/D converted so that the information about the image is stored as digital image data. The digital image data is sent to an image exposing section 68 of a print processing section 10B which will be described hereinafter.

The negative film F having the image which is pick up by the image information picking up section 54 as described above formed thereon is discharged from a discharge exit 26 which is formed at the side surface of the image forming apparatus 10 as shown in FIG. 1. The negative film F which has been discharged from the discharge exit 26 is received by a tray 28.

A photosensitive material cassette 62 in which a heat developing photosensitive material 60 is accommodated and a image receiving paper cassette 66 in which an image receiving paper 64 is accommodated are mounted at predetermined positions of the print processing section 10B.

An image exposing section 68 is provided downstream of the cassette 62 in the conveying direction of the heat developing photosensitive material 60 . The image exposing section 68 exposes an image on the bases of the digital image data which has been transmitted from the image information picking up section 54 in the developing processing section 10A. Further, an application tank 70 is disposed downstream of the image exposing section 68 in the conveying direction of the heat developing photosensitive material 60. Since the application tank 70 is structured in the same manner as the above-described application tank 34, a detailed description thereof will be omitted.

A transfer section 72 is provided at the conveying directional downstream side of the heat developing photosensitive material 60 and the image receiving paper 64. An unillustrated laminating means (not shown) is disposed in the vicinity of the conveying entrance of the transfer section 72. The laminating means laminates the heat developing photosensitive material 60 to which water has been applied and the image receiving paper 64 to each other. A flat heat plate 74 and a conveying belt 76 which is entrained around a pair of rollers 75 are provided at the transfer section 72. The conveying belt 76 is driven by the pair of rollers 75 being rotated by the driving force of ma motor (not shown). As the conveying belt 76 is driven, the heat developing photosensitive material 60 and the image receiving paper 64 which have been laminated to each other are conveyed along the surface of the heat plate 74. Accordingly, a heat-processing is effected by the heat developing photosensitive material 60 and the sheets of image receiving paper 64 which have been laminated to each other are conveyed along the surface of the heat plate 74. The image which has been exposed to the heat developing photosensitive material 60 at the image exposing section 68 is developed and transferred to the image receiving paper 64.

A peeling means which is not shown is provided in the vicinity of the discharging discharge exit of the transfer section 72. The peeling means peels the heat developing photosensitive material 60 from the image receiving paper 64, which have been laminated to each other by the laminating means. A fan 78 as a drying section is provided downstream of the peeling means in the conveying direction of the heat developing photosensitive material. The heat developing photosensitive material 60 is dried by the fan 78 being rotated so as to blow wind thereto. A photosensitive material take up portion 85 is disposed downstream of the fan 78 in the conveying direction of the heat developing photosensitive material. Accordingly, the heat developing photosensitive material 60 which has been dried by the fan 78 is taken up around the photosensitive material take up portion 65 and accommodated therein. Further, at the conveying directional downstream side of the image receiving paper 64, a fan 80 and a cutter (not shown) are provided. The image receiving paper 64 onto which an image has been transferred by the transfer section 72 is dried by the fan 80, and cut by the cutter for each frame of the image. In this way, the image receiving paper 64 which has been cut for each frame of the image is discharged to the outside of the image forming apparatus 10. Moreover, as shown in FIG. 1, the discharge exit of the image receiving paper 64 is formed at the upper portion of the image forming apparatus 10, and is equipped with a discharge tray 20 in the vicinity of the discharge exit. As a result, the image receiving paper 64 which has images printed thereon and is cut is accommodated in the discharge tray 20.

Figure 8:
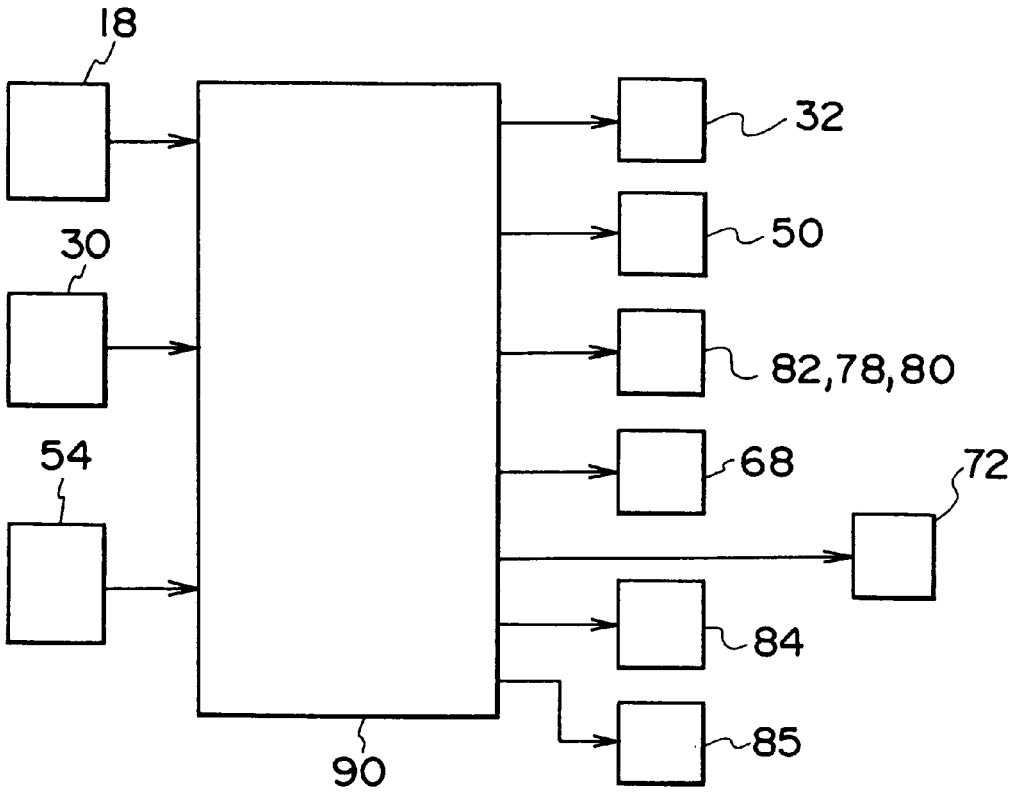
FIG. 8 is a block diagram of a control circuit.
Figure 9:
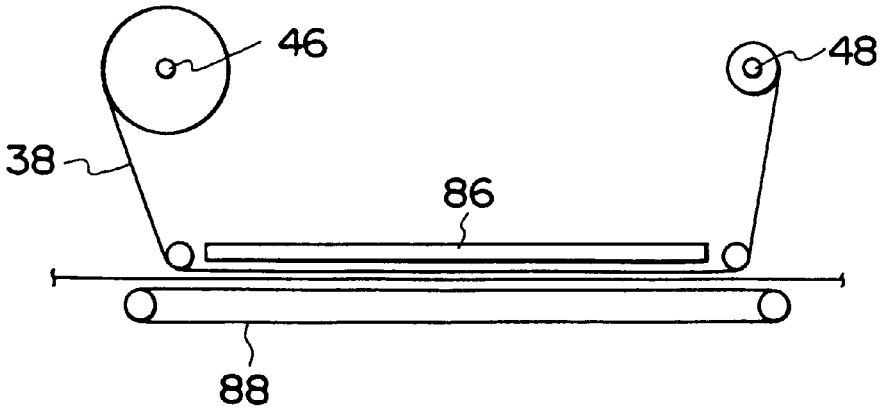
FIG. 9 is a schematic view in the case in which planographic printing is applied to the heat developing section.

As shown in FIG. 1, an operation panel 18 is disposed on the top surface of the casing 12 of the image forming apparatus 10. The operation panel 18 has switches which instruct a user to processing or execute the image forming apparatus 10, and monitors which display the instructed information, or the like. Further, a reference numeral 84 represents a conveying directional switch-over portion in order to switch over the conveying direction of the negative film F into one of directions of the application tank 34 and the image information picking up section 54. As shown in FIG. 8, the aforementioned operation panel 18, the film information detecting section 30, the image information picking up section 54, the cutter 32, the fan 50 and the like are connected to a control circuit 90 which includes a microcomputer.

Figure 3:
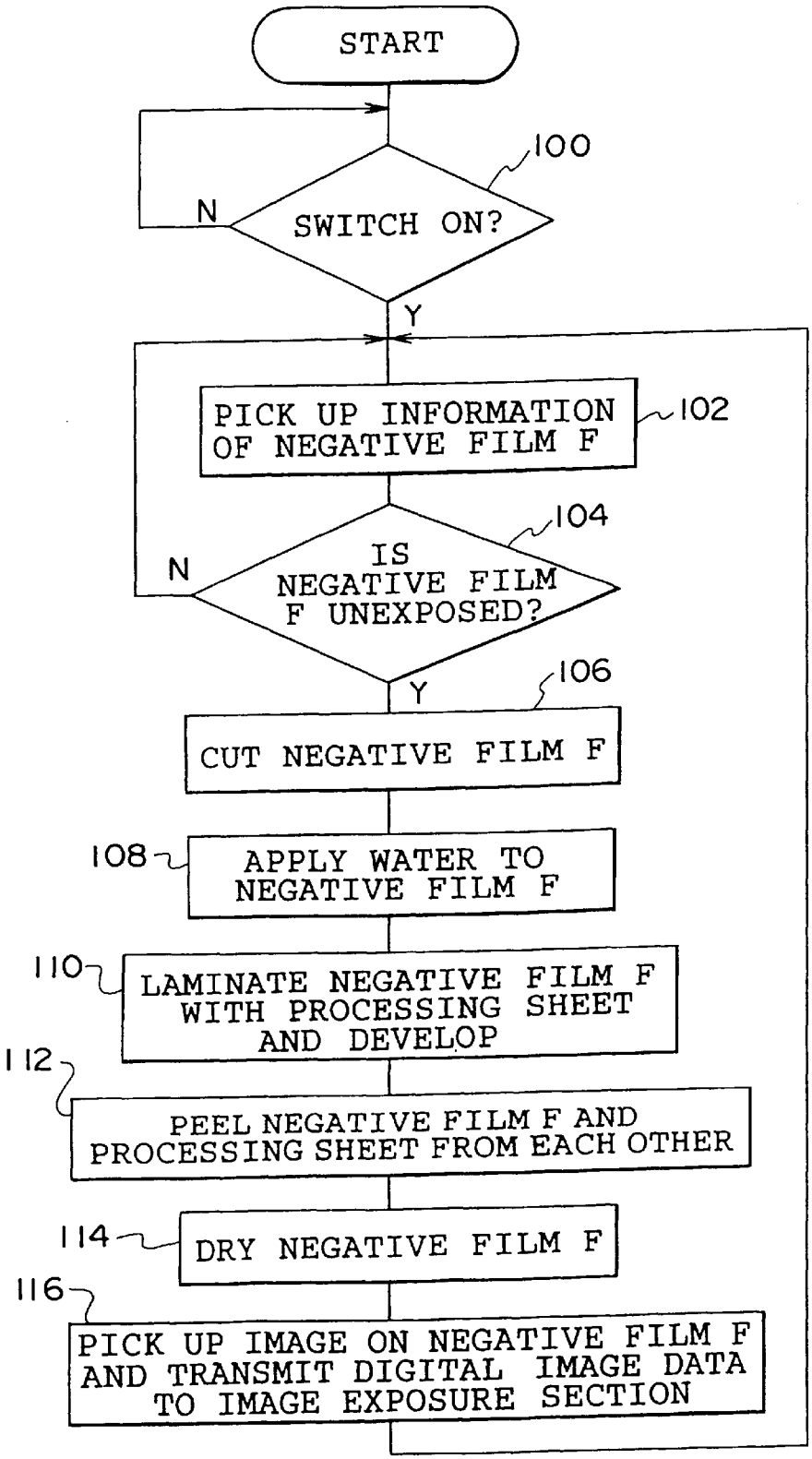
FIG. 3 is a flowchart of a processing routine at a developing processing section of the image forming apparatus.
Figure 4:
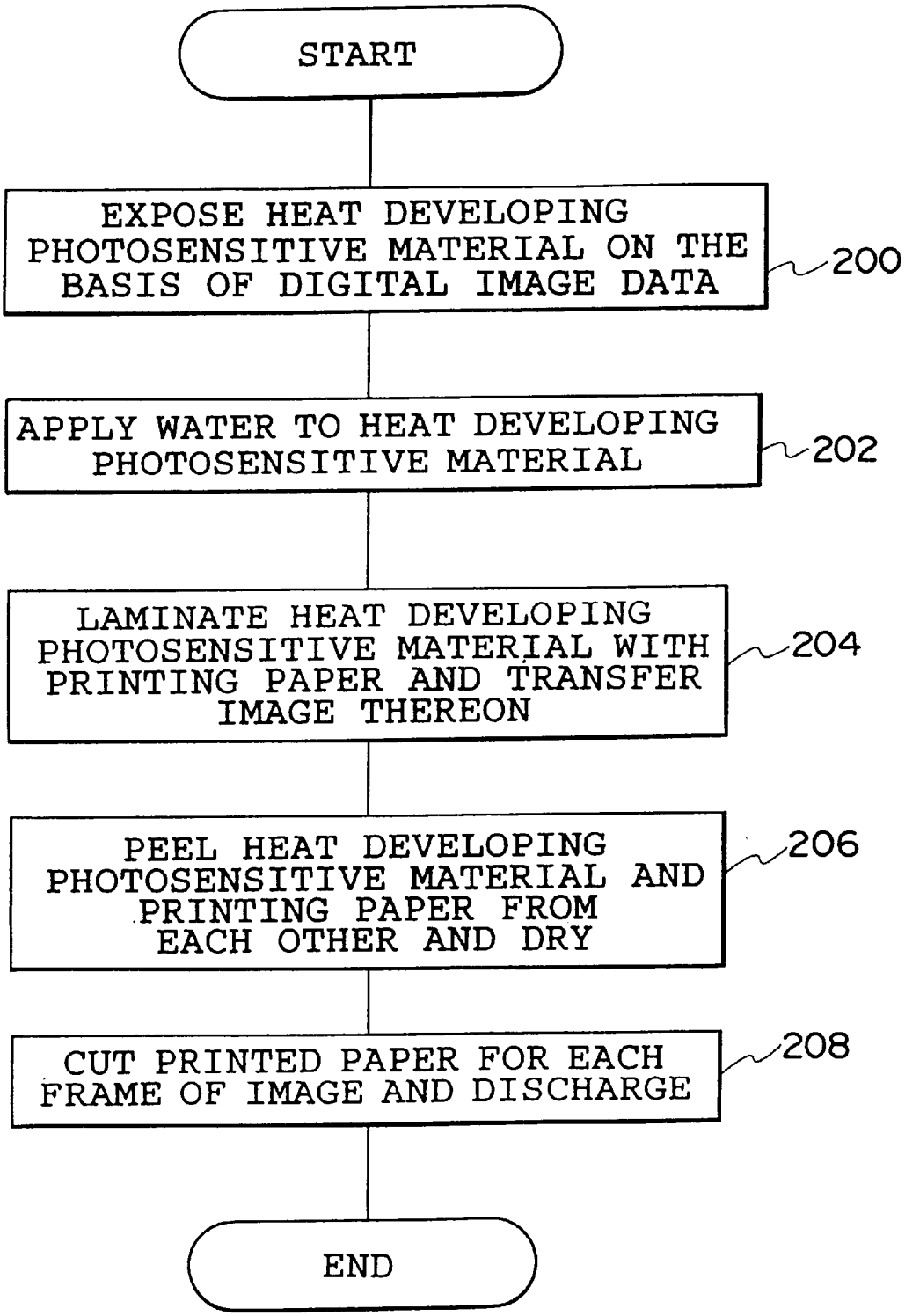
FIG. 4 is a flowchart of a processing routine at a print processing section of the image forming apparatus.

Next, operation of the present embodiment will be explained with reference to the flowcharts which are shown in FIGS. 3 and 4. FIG. 3 shows a processing at the developing processing section 10A of the image forming apparatus 10. FIG. 4 shows a processing at the print processing section 10B of the image forming apparatus 10.

The processings at the developing processing section 10A which are shown in FIG. 3 will be explained. Each of the processings in FIG. 3 is implemented by an operator when she or he loads the cartridge 14 on the cartridge loading portion 16 provided at the image forming apparatus 10.

In Step 100, it is judged whether the operator has switched ON the switch which is provided on the operation panel 18. When it has been determined that the switch is ON, the routine proceeds to Step 102, where information about the negative film F is detected by the film information detecting section 30. Accordingly, the state of the negative film F can be recognized.

In Step 104, it is judged whether the detected portion of the negative film F is unexposed on the basis of the information about the negative film F in the Step 102. The negative film F is exposed from the front side edge portion thereof, and unexposed portion is kept at a portion other than where images have been exposed finally. For this reason, when it has been determined that the detected portion of the negative film F is unexposed, it can be judged that the entire portion of the exposed portion of the negative film F has been pulled out from the cartridge 14. Accordingly, in Step 106, the cutter 32 is operated so as to cut the negative film F, and the negative film F is separated into the exposed portion and the unexposed portion. As a result, the exposed portion of the negative film F is cut away from the spool of the cartridge 14. Next, in Step 108, the negative film F is dipped into the application tank 34, and water as an image forming solvent is applied thereto.

In Step 110, the negative film F and the processing sheet 38 are laminated to each other, and a developing processing is effected thereon at the heat developing section 36. In the heat developing section 36, the negative film F and the processing sheet 38 which are laminated to each other are conveyed along the surface of the heat drum 40. In this way, while the negative film F and the processing sheet 38 which have been laminated to each other are being conveyed, a heat-processing and a pressing processing are effected thereon for a predetermined period of time so that a latent image which is recorded on the negative film F is made distinct. Next, in Step 112, the negative film F and processing sheet 38 which have been laminated to each other are peeled from each other. In Step 114, the negative film F is dried by the fan 50.

Next, in Step 116, the image which has been made distinct on the negative film F is pick up by the image information picking up section 54 and is A/D (Analog to Digital) converted so as to generate digital image data. Further, the digital image data is transmitted to the image exposing section 68 which is provided at the print processing section 10B.

The negative film F having the image thereon thus pick up is discharged from the discharge exit 26 to the outside of the image forming apparatus 10.

Processings at the print processing section 10B which is shown in FIG. 4 will be explained hereinafter. Respective processings in FIG. 4 are implemented after the above-described processing in Step 116 has been completed. In other words, when the digital image data has been transmitted, the processings at the print processing section 10B are effected.

In Step 200, the heat developing photosensitive material 60 is exposed on the basis of the digital image data transmitted by the image exposing section 68. Next, in Step 202, the heat developing photosensitive material 60 is dipped into the application tank 70 and water as an image forming solvent is applied thereto.

In Step 204, the heat developing photosensitive material 60 to which water has been applied is laminated to the image receiving paper 64. The image which has been exposed onto the heat developing photosensitive material 60 is developed and transferred to the image receiving paper 64 at the same time by heat-processing the heat developing photosensitive material and the image receiving paper 64 which have been laminated to each other, by using the heat plate 74 provided at the transfer section 72. As a result, the same image as the latent image which is recorded on the negative film F is printed on the image receiving paper 64.

Next, in Step 206, the heat developing photosensitive material 60 and the image receiving paper 64 which have been laminated to each other in Step 204 are peeled from each other, and they are dry-processed by the fans 78 and 80, respectively. Further, in Step 208, the image receiving paper 64 having a printed image thereon is cut for each frame of the image and is discharged into the discharge tray 20 which is provided at the upper portion of the image forming apparatus 10.

The image receiving paper 64 having the image thus printed is given back to the customer along with the negative film F (the negative film F which is received by the tray 28).

In this way, since a dry film developing machine is employed as the developing processing section 10A of the image forming apparatus 10 and the print processing section 10B which effects each of the exposing processing, the developing processing and the transfer processing on the basis of digital image data is formed integrally with the developing processing section 10A, processings which are necessary for print with film processing can be carried out by using a relatively compact apparatus.

Figure 5:
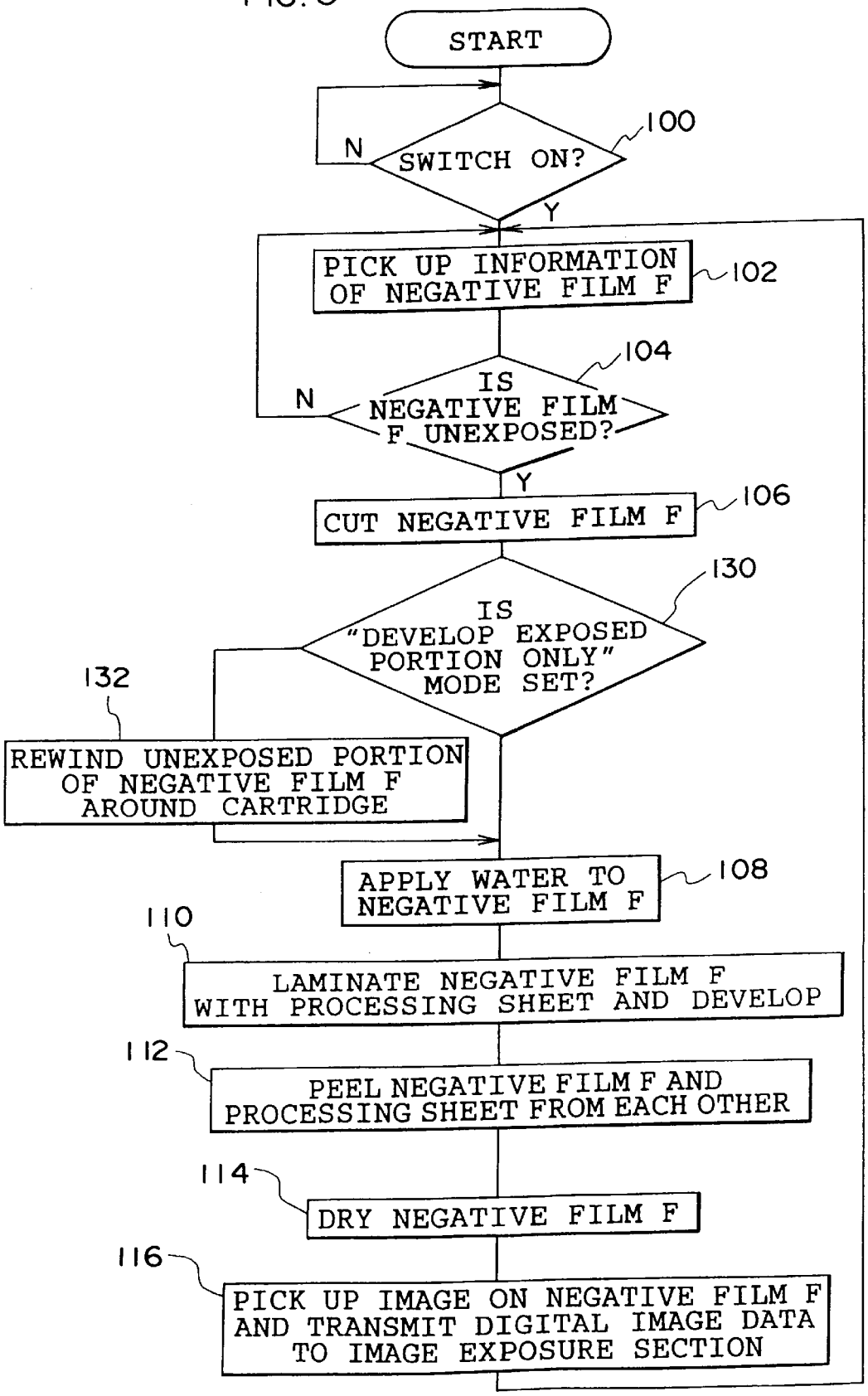
FIG. 5 is a flowchart of a processing routine at the developing processing section of the image forming apparatus.

A mode selection switch may be provided on the operation panel 18 of the image forming apparatus 10. For example, this is the case in which a mode of "develop exposed portions only" which the exposed portions of the negative film F are subjected to be a developing processing or the like is provided on the operation panel 18. In this case, as shown in the flowchart of FIG. 5, Step 106 is followed by Step 130, where it is judged whether the "develop exposed portions only" mode has been set up. In a case in which it is determined that the "develop exposed portions only" mode has been set up, the routine goes to Step 132, where unexposed portions of the negative film F, i.e., the negative film F which is not cut away from the spool of the cartridge 14 is wound back around the cartridge 14. Accordingly, it becomes possible to reuse unexposed portions (unused portions) of the negative film F.

Figure 6:
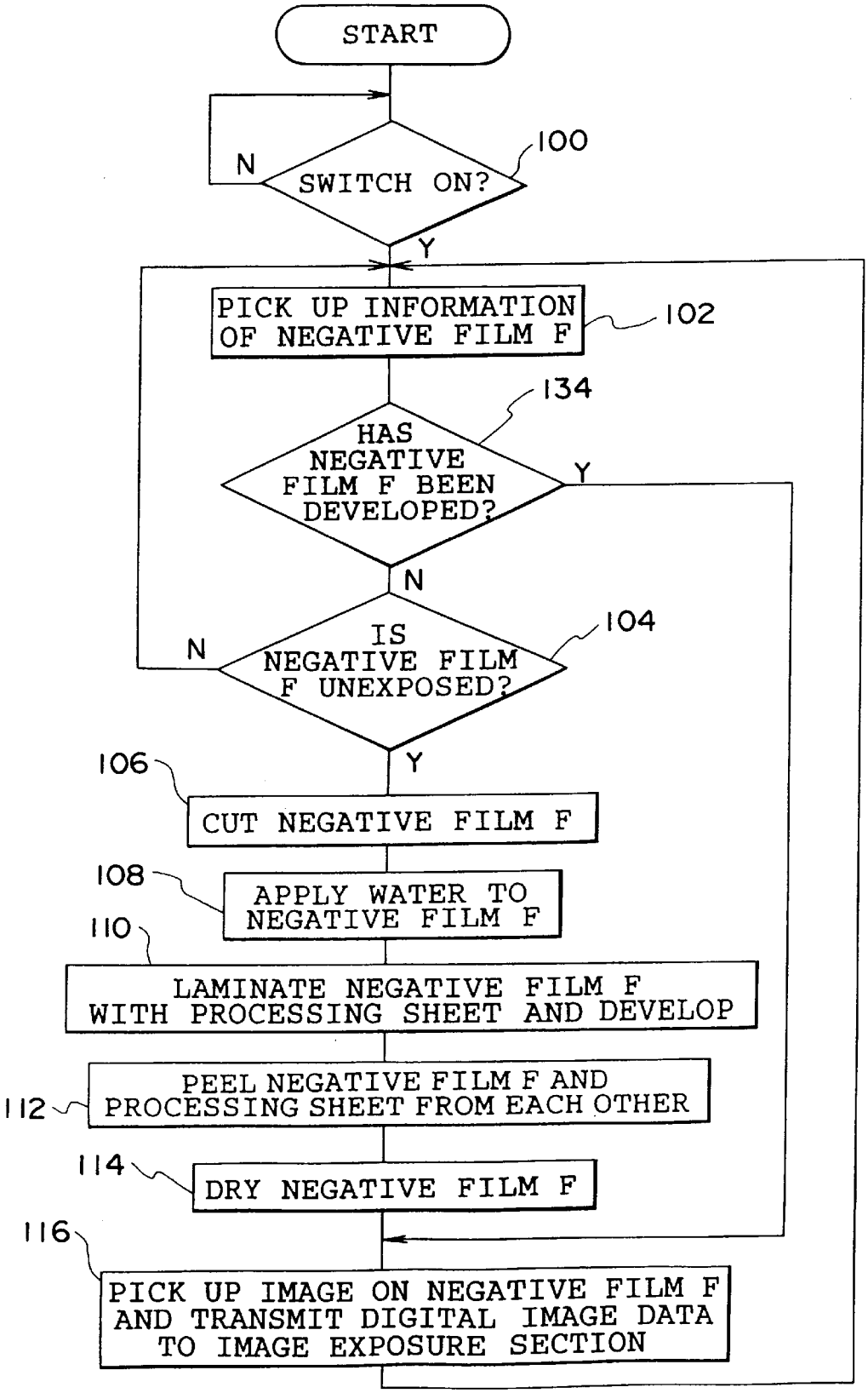
FIG. 6 is a flowchart of a processing routing at a developing processing section according to another embodiment of the present invention.

As shown in the flowchart of FIG. 6, Step 102 may be followed by Step 134 in which it is judged whether the negative film F has been developed. Extra print is taken into consideration in this Step 134. In the case of extra print, the cartridge 14 around which the developed negative film F has been taken up is loaded onto the cartridge loading portion 16 of the image forming apparatus 10. Accordingly, the developing processing at the heat developing section 36 becomes unnecessary. Therefore, in Step 134, in a case in which it is determined that the negative film F has been developed, a conveying directional switch-over portion 84 (see FIG. 2) which is provided between the cutter 32 and the application tank 34 in the developing processing section 10A is changed to a position which is drawn by a dotted line. Accordingly, the developed negative film F is conveyed not to the heat developing section 36 but to the image information picking up section 54 in conformity with the path which is drawn by the imagination line of FIG. 2. In addition, as described above, the negative film F which has not been developed passes through the cutter 32 and the application tank 34, and is conveyed to the heat developing section 36, and is thereby developed.

In the present embodiment, it may be structured such that at least two of all the processings which are carried out at the heat developing section 36 and the image information picking up section 54 both of which are provided at the developing processing section 10A of the image forming apparatus 10, and at the image exposing section 68 and the transfer section 72 both of which are provided at the print processing section 10B can be effected at the same time. Accordingly, while the processings at the print processing section 10B are being carried out, the processings for another cartridge can be effected at the developing processing section 10A. The description of this structure will be given with reference to FIG. 7A.

For example, processings for cartridges A, B and C for which the processings at the developing processing section 10A have been effected previously are carried out at the print processing section 10B of the image forming apparatus 10. In other words, two types of processings which are comprised of image exposure, and development, image transfer or the like, are effected for the cartridges A, B and C on the basis of the image information which is pick up by the image information picking up section 54 of the developing processing section 10A, and is stored as digital image data. At the same time, two types of processings which include a developing processing and a picking up processing of the image information are carried out for the other cartridges D, E and F. Accordingly, two types of processings, which are comprised of a developing processing and a picking up processing of image information, are effected on cartridges D, E and F at the developing processing section 10A and the print processing section 10B. Accordingly, two types of processings are effected for two different types (groups) of cartridges at the developing processing section 10A and the print processing section 10B, respectively. Namely, because a plurality of cartridges can be processed at the same time, print with film processing (simultaneous printing) at the image forming apparatus 10 can be carried out quickly. Further, when an operator checks the cartridge which is loaded on the cartridge loading portion 16, the present state (the processing state) or the like in the image forming apparatus 10 can be taken in by the operator.

Figure 7A:
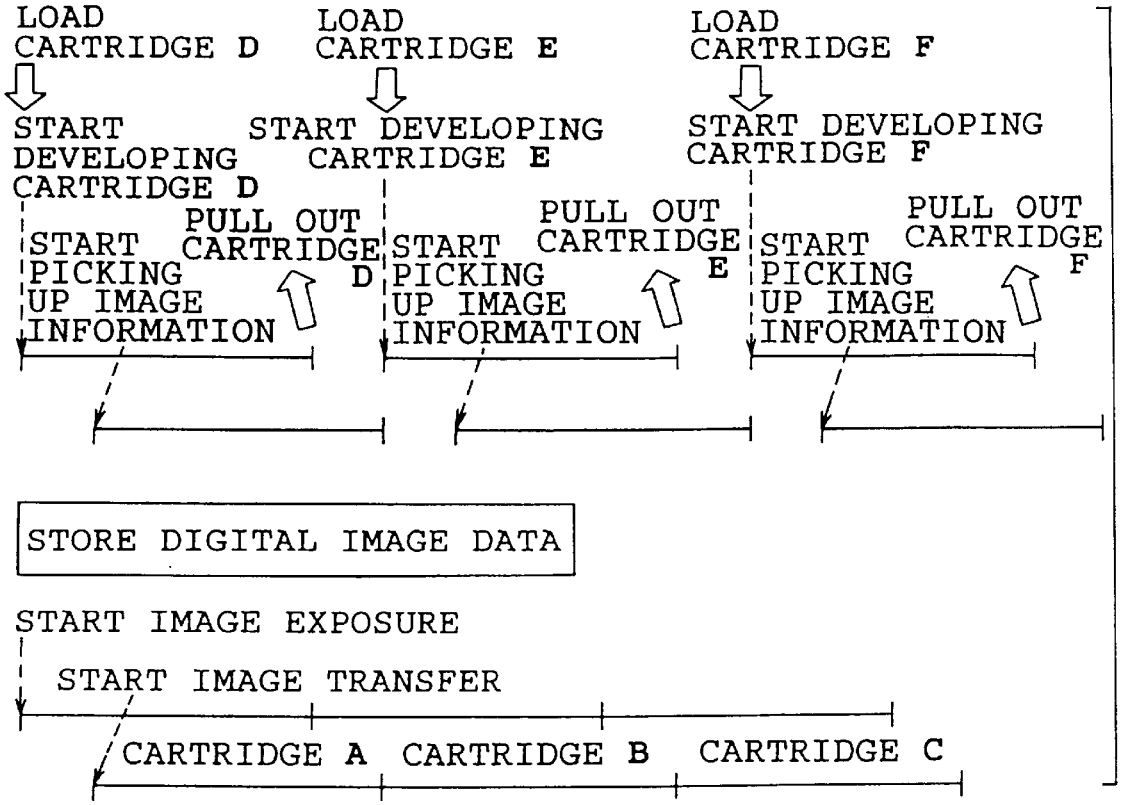
FIG. 7A is a schematic view illustrating the state of processing at the time when the processing of a heat developing section provided at the developing of the image forming apparatus, and respective processings of an image exposing section and a transfer section which are provided at the print processing section are effected at the same time.

In FIG. 7A, the present embodiment is structured such that three of the cartridges A, B and C and three of the cartridges D, E and F have been processed collectively. However, the number of cartridges which are subjected to processings is not limited to this number. Any number can be employed provided that a plurality of cartridges can collectively be processed. In FIG. 7A, it is shown that processings at the heat developing section 36 of the developing processing section 10A and at the image exposing section 68 of the print processing section 10B are started at the same time. However, the timing to start processings is not necessarily the same. For example, merely the processings at the developing processing section 10A are executed, the generated digital image data is stored, and thereafter, each of the processings at the print processing section 10B may be executed on the basis of the stored digital image data. As a result, it becomes unnecessary to allocate an operator who loads cartridges in the cartridge loading portion 16, and an operator who sorts the image receiving paper 64 having printed images. In other words, print with film processing can easily be carried out easily by one operator.

Figure 7B:
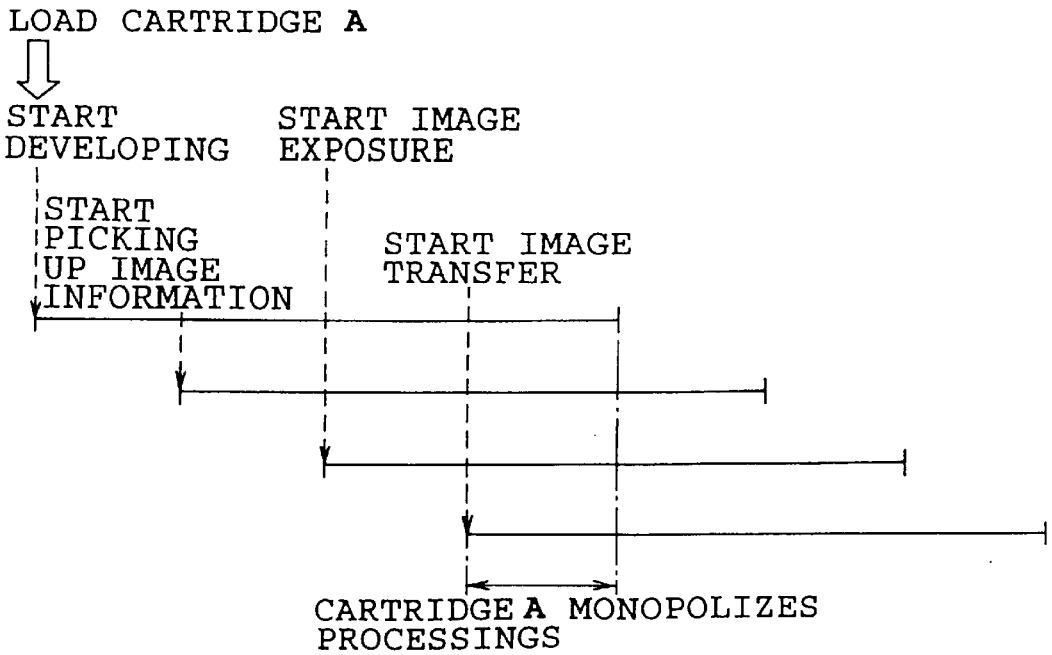
FIG. 7B is a schematic view illustrating the state of the processings at the time when the same negative film F (in one cartridge) is processed.

Further, as shown in FIG. 7B, each of the processings at the heat developing section 36, the image information picking up section 54, the image exposing section 68, and the image transfer section 72 can be effected with respect to the same negative film F (the negative film F within the cartridge A). Accordingly, the single cartridge A is able to monopolize the processings so that rush orders for print with film processing (simultaneous printing) can be dealt with.

In the present embodiment, it is structured such that an image forming solvent is reserved in the application tanks 34 and 70, and the negative film F or the heat developing photosensitive material 60 is dipped into a solvent of each of these application tanks 34 and 70, and the image forming solvent is applied thereto. However, it is not limited to this structure. For example, a pipe having a plurality of pores formed thereon may be used in order to apply the image forming solvent to the negative film F by ejecting the image forming solvent from the pores of the pipe (LJ: Line Jet). Water is allowed to soak into a soft material such as sponge or the like. The negative film F is conveyed along the surface of the sponge so as to apply the image forming solvent to the negative film F (STC: Soft Touch Coating).

In the present embodiment, as the structure of the heat developing section 36 at the developing processing section 10A, a drum development system using the heat drum 40 has been employed. However, as shown in FIG. 8, a planographic development system which is formed by a flat heat plate 86 and a conveying belt 88 is applicable to the present embodiment. The planographic development system has also been applied as the transfer section 72 at the print processing section 10B. However, it is not limited to this. A drum development system which makes use of a heating drum can be employed. In addition, as the heat developing section 36 of the developing processing section 10A, a stamp development system which stops and processes each frame of the image on the negative film F can be applied.

In the present embodiment, although the application temperature has been set to 40° C. and the application time has been set to 2.5 seconds when the negative film F is dipped into the application tank 34, it is not limited to these figures. For example, the application temperature may be set to 20 to 80° C., the application time may be set to from 1 to 5 seconds. Although the developing temperature at the heat developing section 36 has been set to 80° C. and the developing time has been set to 15 seconds, the developing temperature may be set to 60 to 95° C. and the developing time may be set to 5 to 50 seconds.

In the present embodiment, the fans 50, 78 and 80 are used as means in order to dry the heat developing photosensitive material 60 and the image receiving paper 64. However, it is not limited to this. For example, a fan and a heater can be used together, or a heater can be used alone.

What is claimed is:

1. An image forming apparatus, comprising:

dry developing processing means which carries out a developing processing which makes visible a latent image which has been recorded on a photosensitive material by laminating to each other the photosensitive material on which the latent image has been recorded and a processing material containing a processing agent, and carrying out a heat-processing thereon;

data generating means which picks up an image which has been developed and generates digital image data;

exposing means which exposes a heat developing photosensitive material on the basis of said digital image data so that a latent image corresponding to said digital image data is recorded; and heat developing transfer means which carries out a developing processing which makes visible the latent image, which has been recorded on a heat developing photosensitive material, by laminating to each other the heat developing photosensitive material which has been exposed and an image receiving material, and carrying out a heat-processing thereon, and a transfer processing which transfers the image which has been developed onto said image receiving material.

2. An image forming apparatus according to claim 1, further comprising:

first conveying means which conveys said photosensitive material through said dry developing processing means and said data generating means and then discharges it to the exterior portion of the image forming apparatus; and second conveying means which conveys said image receiving material through said exposing means and said heat developing transfer means and then discharges it to the exterior portion of said image forming apparatus.

3. An image forming apparatus according to claim 1, wherein said heat developing transfer means carries out the heat-processing in the presence of an image forming solvent.

4. An image forming apparatus according to claim 1, wherein at least two of the processings of said dry developing processing means, said data generating means, said exposing means, and said heat developing transfer means can be carried out at the same time.

5. An image forming apparatus according to claim 1, wherein the processings of said dry developing processing means, said data generating means, said exposing means, and said heat developing transfer means can be carried out at the same time on the basis of the image which has been recorded on the same photosensitive material.

6. An image forming apparatus, comprising:

detecting means which detects either the exposed portion or the unexposed portion of a photosensitive material;

separating means which separates said photosensitive material into a first portion which includes the exposed portion of said photosensitive material and a second portion which does not include the exposed portion;

dry developing processing means which carries out a developing processing which makes visible a latent image which has been recorded on said photosensitive material through exposure by laminating to each other said first portion of the photosensitive material which has been separated by said separating means and a processing material containing a processing agent, and carrying out a heat-processing thereon;

data generating means which picks up the image which has been developed and generates digital image data;

exposing means which exposes a heat developing photosensitive material on the basis of said digital image data so that a latent image corresponding to said digital image data is recorded; and heat developing transfer means which carries out a developing processing which makes visible the latent image which has been recorded on a heat developing photosensitive material, by laminating to each other the heat developing photosensitive material which has been exposed and an image receiving material, and carrying out a heat-processing thereon, and a transfer processing which transfers the image which has been developed onto said image receiving material.

7. An image forming apparatus according to claim 6, further comprising take up means which takes up the second portion of said photosensitive material into a cartridge.

8. An image forming apparatus according to claim 6, further comprising:

first conveying means which conveys the first portion of said photosensitive material through said dry developing processing means and said data generating means and then discharges it to the exterior portion of said image forming apparatus; and second conveying means which conveys the second portion of said photosensitive material through said exposing means and said heat developing transfer means and then discharges it to the exterior portion of said image forming apparatus.

9. An image forming apparatus according to claim 6, wherein said heat developing transfer means carries out a heat-processing in the presence of an image forming solvent.

10. An image forming apparatus according to claim 6, wherein at least two of the processings of said dry developing processing means, said data generating means, said exposing means, and said heat developing transfer means can be carried out at the same time.

11. An image forming apparatus according to claim 6, wherein the processings of said dry developing processing means, said data generating means, said exposing means, and said heat developing transfer means can be carried out at the same time on the basis of the image which has been recorded on the same photosensitive material.

12. An image forming apparatus, comprising:

detecting means which detects whether a photosensitive material has been developed or not;

dry developing processing means which carries out a developing processing which makes visible a latent image which has been recorded on a photosensitive material by laminating to each other the photosensitive material which has not been developed and on which the latent image has been recorded, and a processing material containing a processing agent, and carrying out a heat-processing thereon;

data generating means which generates digital image data by picking up the image which has been recorded on a photosensitive material which is detected by said detecting means to have been developed, and by picking up the image which has been recorded on the photosensitive material which has been developed by said developing processing means;

exposing means which exposes a heat developing photosensitive material on the basis of the digital image data so that a latent image corresponding to said digital image data is recorded; and heat developing transfer means which carries out a developing processing which makes visible a latent image which has been recorded on a heat developing photosensitive material by laminating to each other said heat developing photosensitive material which has been exposed and an image receiving material, and carrying out a heat-processing thereon, and a transfer processing which transfers the image which has been developed onto said image receiving material.

13. An image forming apparatus according to claim 12, further comprising:

first conveying means which conveys said undeveloped photosensitive material through said dry developing processing means and said data generating means and then discharges it to the exterior portion of the image forming apparatus, and which conveys the photosensitive material which is detected by said detecting means to have been developed, through said data generating means and then discharges it to the exterior portion of the image forming apparatus; and second conveying means which conveys said image receiving material through said exposing means and said heat developing transfer means and then discharges it to the exterior portion of the image forming apparatus.

14. An image forming apparatus according to claim 12, wherein said heat developing transfer means carries out a heat-processing in the presence of an image forming solvent.

15. An image forming apparatus according to claim 12, wherein at least two of the processings of said dry developing processing means, said data generating means, said exposing means, and said heat developing transfer means can be carried out at the same time.

16. An image forming apparatus according to claim 12, wherein the processings of said dry developing processing means, said data generating means, said exposing means, and said heat developing transfer means can be carried out at the same time on the basis of the image which has been recorded on the same photosensitive material.

* * * * *